US010408392B2

(12) United States Patent
Yu

(10) Patent No.: US 10,408,392 B2
(45) Date of Patent: Sep. 10, 2019

(54) OUTDOOR LAMP HOLDER AND OUTDOOR LAMP STRING USING SAME

(71) Applicant: NINGBO WELL ELECTRIC APPLANCE CO., LTD., Ningbo (CN)

(72) Inventor: Guolin Yu, Ningbo (CN)

(73) Assignee: NINGBO WELL ELECTRIC APPLANCE CO., LTD., Ningbo (CN)

( * ) Notice: Subject to any disclaimer, the term of this patent is extended or adjusted under 35 U.S.C. 154(b) by 146 days.

(21) Appl. No.: 15/412,015

(22) Filed: Jan. 22, 2017

(65) Prior Publication Data

US 2017/0343169 A1 Nov. 30, 2017

(30) Foreign Application Priority Data

May 27, 2016 (CN) ..... 2016 1 0368870
Dec. 13, 2016 (CN) ..... 2016 1 1144429

(51) Int. Cl.

| | |
|---|---|
| ***F21S 4/10*** | (2016.01) |
| ***F21V 21/08*** | (2006.01) |
| ***F21V 23/00*** | (2015.01) |
| ***F21V 23/06*** | (2006.01) |
| *F21Y 115/10* | (2016.01) |
| *F21W 131/10* | (2006.01) |

(52) U.S. Cl.

CPC ..... *F21S 4/10* (2016.01); *F21V 23/002* (2013.01); *F21W 2131/10* (2013.01); *F21Y 2115/10* (2016.08)

(58) Field of Classification Search

CPC ..... F21S 4/00; F21S 4/10; F21S 4/15; F21S 4/20; F21V 23/002; F21W 2131/10

See application file for complete search history.

(56) References Cited

U.S. PATENT DOCUMENTS

| | | | | |
|---|---|---|---|---|
| 6,062,705 | A * | 5/2000 | Zimmer | H01R 33/965 362/249.01 |
| 8,070,347 | B1 * | 12/2011 | Lin | F21V 31/00 362/391 |
| 9,739,471 | B1 * | 8/2017 | Chen | F21V 31/00 |
| 2011/0309403 | A1 * | 12/2011 | Kawashima | F21V 31/00 257/99 |
| 2012/0033439 | A1 * | 2/2012 | Liu | F21V 19/0005 362/457 |
| 2013/0051079 | A1 * | 2/2013 | Xu | F21S 6/001 362/640 |
| 2015/0211727 | A1 * | 7/2015 | Loomis | F21V 3/02 362/311.02 |
| 2017/0159922 | A1 * | 6/2017 | Chen | F21V 15/01 |

* cited by examiner

*Primary Examiner* — Alexander K Garlen
*Assistant Examiner* — Eric T Eide

(57) ABSTRACT

The present disclosure provide an outdoor lamp holder. The outdoor lamp holder includes a bulb engaging with a bulb fixing seat, a light guide pole received in the bulb, and a lamp holder assembly comprising an LED light board, a tail female terminal, a wire, a tail inserted sleeve, and a tail inserted body. One end of the bulb fixing seat away from the bulb has a protrusion with threads. The LED light board, the tail female terminal, and the wire electrically are connected in turn. The wire and the tail female terminal fixedly are connected in a riveted manner. The tail female terminal is assembled with the tail inserted sleeve. Connection points between the tail female terminal and the LED light board are arranged inside the tail inserted sleeve. The tail inserted body sleeves around the tail inserted sleeve.

10 Claims, 2 Drawing Sheets

OUTDOOR LAMP HOLDER AND OUTDOOR LAMP STRING USING SAME

This application claims the priorities of Chinese patent application number 201611144429.3, filed on Dec. 13, 2016, the entire contents of which are incorporated herein by reference.

FIELD OF THE DISCLOSURE

The present disclosure relates to outdoor lighting technologies, in particular, relates to an outdoor lamp holder and an outdoor lamp string having the outdoor lamp holder.

BACKGROUND OF THE DISCLOSURE

Outdoor lamps are light devices exposed at outdoor. The outdoor lamp is usually designed with the roads, landscape, architecture to achieve functional and artistical goal. It is understood that the outdoor lamp, in order to meet the requirements for outdoor use, should has better waterproof performance than other types of luminaires.

Outdoor lamp string is one type of the outdoor lamp and is composed of a power line having a certain length and a number of lamp holders arranged on and electrically connected to the power line. The lamp holders are spaced apart from each other so that the power line can be hung in a place where needs to be lighted, to make a large area lighting and a good decoration in the specific use of the outdoor lamp string.

Currently, in the existing outdoor lamp string, the power line is coupled with the female terminal by means of soldering. It is understood that soldering easily make a poor electrical contact between the power line and the female terminal, thereby affecting the lighting effects. In addition, the fixation strength between the power line and the female terminal is not good and easily makes it prone to loose.

BRIEF DESCRIPTION OF THE DRAWINGS

In order to illustrate more clearly with prior arts or embodiment of the present disclosure, the figures needed to be used in the embodiments of the present disclosure or prior arts will be described briefly in the following section. It is noted that the figures described below only relate to some embodiments of the present disclosure. For ordinary person skilled in the art, some other drawings according to these drawings can be easily got without paying creative work.

DETAILED DESCRIPTION OF ILLUSTRATED EMBODIMENTS

To make the objectives, technical solutions, and advantages of the present disclosure clearer, the present disclosure is further described in detail in combination with specific embodiments and attached drawings. It should be understood that the embodiments described here are only exemplary ones for illustrating the present disclosure, and are not intended to limit the present disclosure.

Figure 1:
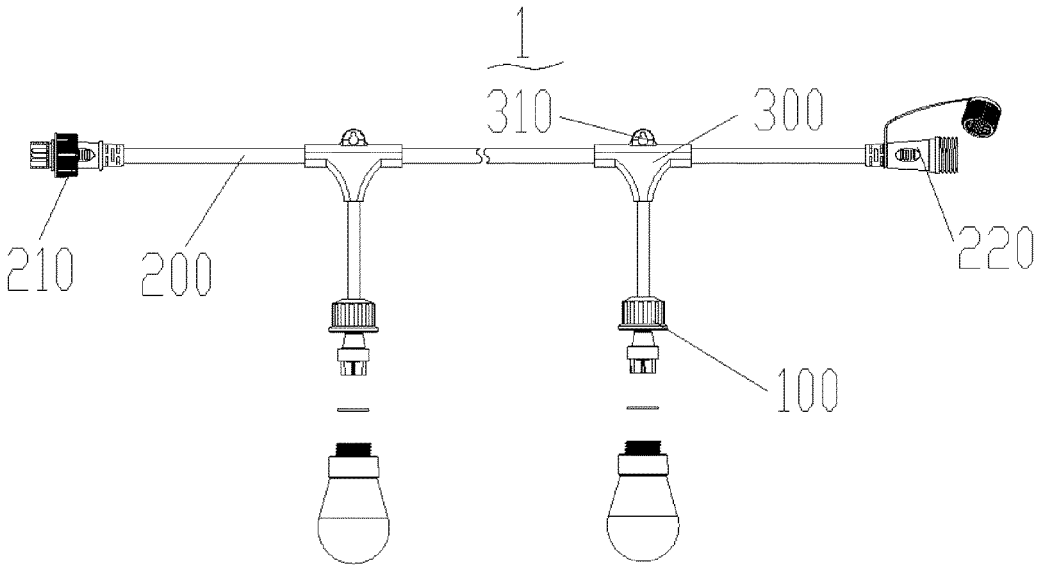
FIG. 1 is a schematic diagram of structure of an outdoor lamp string according to an embodiment of the present disclosure.

Please refer to FIG. 1, one embodiment of this disclosure provides an outdoor lamp string 1. The outdoor lamp string 1 includes a power line 200 and a number of outdoor lamp holders 100 electrically connected to the power line 200. A wire 60 of each of the outdoor lamp holders 100 is perpendicular to the power line 200 and is electrically connected to the power line 200.

The power line 200 is applied in the outdoor lamp string 1, and is configured to direct external current to the outdoor lamp holders 100 and to provide power to the outdoor lamp holders 100.

It is understood that opposite ends of the power line 200 are coupled with a male connector 210 and a female connector 220, respectively. The male connector 210 matches with the female connector 220. The male connector 210 of one outdoor lamp string 1 engages with the female connector 220 of neighboring outdoor lamp string 1, thereby multiple of outdoor lamp strings 1 can be combined to use when the outdoor lamp strings 1 is in use, according to requirements. That is, the outdoor lamp string 1 of the present embodiment can be designed to an arbitrary length according to the user's demand for use.

In this embodiment, a series connector 300 is arranged at each of connection points between the power line 200 and the wire 60 of outdoor lamp holders 100. The series connector 300 wraps the connection point and provides sealing protection to the connection point, in order to better adapt to the outdoor use requirements. Preferably, the series connector 300 has a hook 310 on a side away from the outdoor lamp holder 100. The outdoor lamp holder 100 can be hung by the hook 310.

Figure 2:
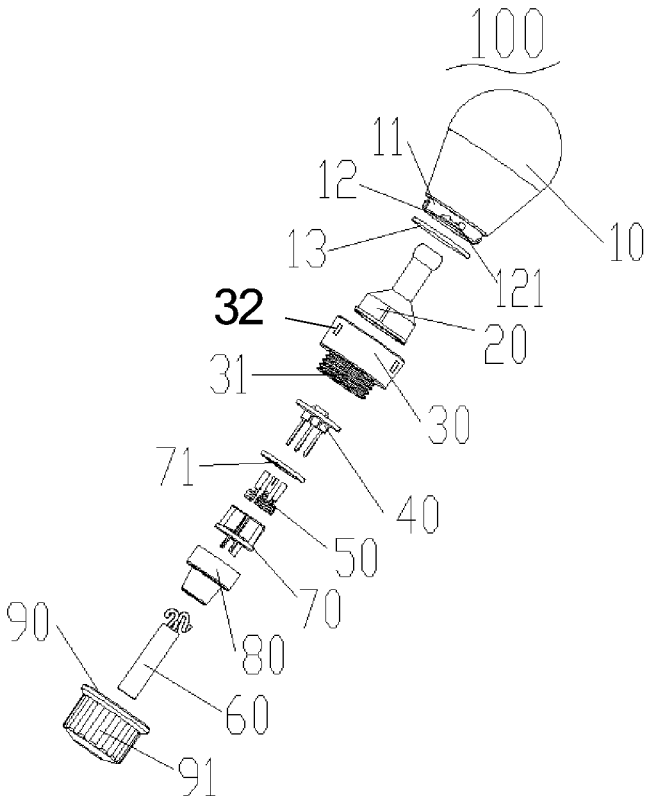
FIG. 2 is an exploded view of an outdoor lamp holder according to an embodiment of the present disclosure.

Please refer to FIG. 2, the outdoor lamp holder 100 includes a lamp bulb 10, a light guide pole 20, a bulb fixing seat 30, an LED light board 40, a tail female terminal 50, a wire 60, a tail inserted sleeve 70, a tail inserted body 80, and a nut 90. For ease of illustration, in this embodiment, the LED light board 40, the tail female terminal 50, the wire 60, the tail inserted sleeve 70, and the tail inserted body 80 are components of the lamp holder assembly.

In particular, one end of the bulb fixing seat 30 engages with the bulb 10, and the other end of the bulb fixing seat 30 has a protrusion 31 with threads. The protrusion 31 is configured to engage with the nut 90. The nut 90 covers the wire 60. This allows the outdoor lamp holder 100 of the present embodiment to improve the anti-looseness of the outdoor lamp holder 100 comparing with the prior art, thus ensuring the stability of the electrical connection of the outdoor lamp holder 100 to be suitable for outdoor use.

Specifically, the bulb 10 is provided with a flange 11, and at least two inverted clamps 12 are provided at the end of the flange 11. Correspondingly, an inner wall of the bulb fixing seat 30 has protruding clamps 32 corresponding to the inverted clamps 12, thereby the bulb fixing seat 30 can be connected to the bulb 10 in a manner that the protruding clamps 32 engage with the inverted clamps 12 to achieve anti-looseness function. In this embodiment, a recess 121 is defined in each of the inverted clamps 12. The protruding clamps 32 engage in the recesses 121 of the inverted clamps 12 when the bulb fixing seat 30 is connected to the bulb 10, so that the bulb fixing seat 30 can be restricted from rotating along the axial direction of the bulb 10. In other words, after coupling the bulb fixing seat 30 with the bulb 10, the bulb fixing seat 30 is fixed relative to the bulb 10. This improves the anti-looseness function and makes a convenience for coupling the nut 90 with of the protrusion 31 of the bulb fixing seat 30.

In this embodiment, a waterproof rubber ring 13 sleeves the flange 11 of the bulb 10, thus the contact surface between the bulb fixing seat 30 and the bulb 10 is sealed to improve waterproof function. In particular, when the bulb fixing seat 30 is coupled with the bulb 10, the waterproof rubber ring 13 tight abuts against between the bulb 10 and the bulb fixing seat 30. That is, when the bulb fixing seat 30 engages with the bulb 10, the waterproof rubber ring 13 is pressed by the bulb fixing seat 30 and the bulb 10 for waterproof function.

It is understood that the LED light board 40, the tail female terminal 50, and the wire 60 are electrically connected in turn. The current passes through the wire 60, the tail female terminal 50, and the LED light board 40 in turn and lights the LED light board 40 when the outdoor lamp holder 100 works. In this embodiment, a light emitting panel (not shown) of the LED light board 40 abuts against the end face of the light guide pole 20, which protrudes from one side of the bulb 10, in order to improve the decorative effect when the outdoor lamp holder 100 works.

In this embodiment, the wire 60 and the tail female terminal 50 are fixedly connected in a crimping manner in place of soldering manner in the prior art. It can be understood that the connection strength between the wire 60 and the tail female terminal 50 in a crimping manner is better, and the stability of the electrical connection of the outdoor lamp holder 100 can be ensured.

In addition, the tail female terminal 50 is assembled with the tail inserted sleeve 70. Connection points between the tail female terminal 50 and the LED light board 40 are arranged inside the tail inserted sleeve 70. The tail inserted body 80 sleeves the tail inserted sleeve 70, and the crimped contacts between the tail female terminal 50 and the wire 60 is arranged in the tail inserted body 80. That is, in this embodiment, electrical connections of the outdoor lamp holder 100 are arranged inside the tail inserted sleeve 70 and the tail inserted body 80 to protect the electrical connections. Further, a waterproof gasket 71 having a flat shape sleeves the tail inserted sleeve 70. An external diameter of the waterproof gasket 71 is larger than that of the tail inserted sleeve 70, thereby the waterproof gasket 71 abuts against between the protrusion 31 of the bulb fixing seat 30 and the tail inserted body 80 when the tail inserted body 80 is assembled with the tail inserted sleeve 70. The waterproof gasket 71 has a surface abutting against the bulb fixing seat 30 and an opposite surface abutting against the tail inserted body 80. That is, when the nut 90 engages with the protrusion 31 of the bulb fixing seat 30, the nut 90 presses the waterproof gasket 71 to abut the protrusion 31 of the bulb fixing seat 30 to achieve the waterproof function. This makes the sealing between the protrusion 31 of the bulb fixing seat 30 and the tail inserted body 80 and improves the waterproof function of the outdoor lamp holder 100.

As a preferred embodiment of the present disclosure, the outer peripheral surface of the nut 90 is provided with a friction strip 91, thus the nut 90 is easily hold when the nut 90 is screwed to the protrusion 31 of the bulb fixing seat 30.

In summary, outdoor lamp holder 100 of the present disclosure is arranged by the above-mentioned reasonable structure. The outdoor lamp holder 100 can be tightened by the nut 90 after the electrical connection of the outdoor lamp holder 100, so as to improve the anti-loosening force of the outdoor lamp holder 100. During the process of screwing the nut 90, the nut 90 can press the waterproof gasket 71 and the waterproof rubber ring 13 to get a better waterproof function for outdoor use.

Described above are merely preferred embodiments of the present disclosure, but are not intended to limit the present disclosure. Any modification, equivalent replacement, or improvement made without departing from the spirit and principle of the present disclosure should fall within the protection scope of the present disclosure.

What is claimed is:

1. An outdoor lamp holder, comprising:

a bulb engaging with a bulb fixing seat, one end of the bulb fixing seat away from the bulb having a protrusion with threads;

a light guide pole received in the bulb; and a lamp holder assembly comprising an LED light board, a tail female terminal, a wire, a tail inserted sleeve, and a tail inserted body, the LED light board, the tail female terminal, and the wire electrically connected in turn, the wire and the tail female terminal fixedly connected in a crimping manner; the tail female terminal assembled with the tail inserted sleeve, connection points between the tail female terminal and the LED light board arranged inside the tail inserted sleeve, the tail inserted body sleeving around the tail inserted sleeve, and crimping contacts between the tail female terminal and the wire arranged inside the tail inserted body; and a nut screwed to the protrusion of the bulb fixing seat so that the tail inserted body is received in the bulb fixing seat, wherein the bulb is provided with a flange, and at least two inverted clamps are provided at the end of the flange, an inner wall of the bulb fixing seat has protruding clamps corresponding to the inverted clamps;

a recess is defined in each of the inverted clamps, the protruding clamps engage in the recesses of the inverted clamps when the bulb fixing seat is connected to the bulb, so that the bulb fixing seat can be restricted from rotating along the axial direction of the bulb;

wherein a waterproof gasket sleeves the tail inserted sleeve, an external diameter of the waterproof gasket is larger than that of the tail inserted sleeve, the waterproof gasket is sandwiched between and abuts against the protrusion of the bulb fixing seat and the tail inserted body when the tail inserted body is assembled with the tail inserted sleeve, the waterproof gasket is separable from the tail inserted body and the bulb fixing seat; the waterproof gasket having a flat shape, a surface abutting against the bulb fixing seat and an opposite surface abutting against the tail inserted body.

2. The outdoor lamp holder of claim 1, wherein a waterproof rubber ring sleeves the flange of the bulb, the waterproof rubber ring tight abuts against between the bulb and the bulb fixing seat, when the bulb fixing seat is coupled with the bulb.

3. The outdoor lamp holder of claim 1, wherein the outer peripheral surface of the nut is provided with a friction strip.

4. The outdoor lamp holder of claim 1, wherein a light emitting panel of the LED light board abuts against the end face of the light guide pole protruding from the bulb.

5. An outdoor lamp string, comprising:

a power line; and a plurality of outdoor lamp holders electrically connected to the power line, a wire of each of the outdoor lamp holders being perpendicular to the power line and electrically connected to the power line; the outdoor lamp holder, comprising:

a bulb engaging with a bulb fixing seat, one end of the bulb fixing seat away from the bulb having a protrusion with threads;

a light guide pole received in the bulb; and a lamp holder assembly comprising an LED light board, a tail female terminal, a tail inserted sleeve, and a tail inserted body, the LED light board, the tail female terminal, and the wire electrically connected in turn, the wire and the tail female terminal fixedly connected in a crimping manner; the tail female terminal assembled with the tail inserted sleeve, connection points between the tail female terminal and the LED light board arranged inside the tail inserted sleeve, the tail inserted body sleeving around the tail inserted sleeve, and crimping contacts between the tail female terminal and the wire arranged inside the tail inserted body; and a nut screwed to the protrusion of the bulb fixing seat so that the tail inserted body is received in the bulb fixing seat, wherein the bulb is provided with a flange, and at least two inverted clamps are provided at the end of the flange, an inner wall of the bulb fixing seat has protruding clamps corresponding to the inverted clamps;

a recess is defined in each of the inverted clamps, the protruding clamps engage in the recesses of the inverted clamps when the bulb fixing seat is connected to the bulb, so that the bulb fixing seat can be restricted from rotating along the axial direction of the bulb;

wherein a waterproof gasket sleeves the tail inserted sleeve, an external diameter of the waterproof gasket is larger than that of the tail inserted sleeve, the waterproof gasket is sandwiched between and abuts against the protrusion of the bulb fixing seat and the tail inserted body when the tail inserted body is assembled with the tail inserted sleeve, the waterproof gasket is separable from the tail inserted body and the bulb fixing seat; the waterproof gasket having a flat shape, a surface abutting against the bulb fixing seat and an opposite surface abutting against the tail inserted body.

6. The outdoor lamp string of claim 5, wherein a waterproof rubber ring sleeves the flange of the bulb, the waterproof rubber ring tight abuts against between the bulb and the bulb fixing seat, when the bulb fixing seat is coupled with the bulb.

7. The outdoor lamp string of claim 5, wherein the outer peripheral surface of the nut is provided with a friction strip.

8. The outdoor lamp string of claim 5, wherein a light emitting panel of the LED light board abuts against the end face of the light guide pole protruding from the bulb.

9. The outdoor lamp string of claim 5, wherein the outdoor lamp string further comprises series connectors, each of the series connectors is arranged at each of connection points between the power line and the wire of outdoor lamp holders.

10. The outdoor lamp string of claim 9, wherein each of the series connectors comprises a hook on a side away from the outdoor lamp holder.

* * * * *